United States Patent [19]

Lei et al.

[11] Patent Number: 4,554,058

[45] Date of Patent: Nov. 19, 1985

[54] ELECTROLYTIC PRODUCTION OF PRECIOUS METALS

[75] Inventors: Kenneth P. V. Lei, Sparks; Judith A. Eisele, Verdi; Gene E. McClelland, Sparks, all of Nev.

[73] Assignee: The United States of America as represented by the Secretary of Interior, Washiongton, D.C.

[21] Appl. No.: 710,759

[22] Filed: Mar. 11, 1985

[51] Int. Cl.[4] ..... C25C 1/20

[52] U.S. Cl. ..... 204/110; 204/109; 204/111; 204/294; 75/83

[58] Field of Search ..... 204/109, 110, 130, 292–293, 204/294; 75/83; 502/20

[56] References Cited

U.S. PATENT DOCUMENTS 3,920,403 11/1975 Ross ..... 204/110

*Primary Examiner*—R. L. Andrews

*Attorney, Agent, or Firm*—E. Philip Koltos; Thomas Zack

[57] ABSTRACT

An electrolytic process for the desorption of precious metals such as gold and silver. The precious metal complexes are loaded on activated carbon particles that are packed into a hollow, cylindrical graphite container and the container is connected as the anode of an electrolytic cell. The electrolyte is a suitable alkaline solution and the cathode can be graphite, antimony or copper. Upon the application of an electric current, the precious metal complexes are desorbed and reduced to precious metals on the cathode.

15 Claims, No Drawings

ELECTROLYTIC PRODUCTION OF PRECIOUS METALS

FIELD OF THE INVENTION

The present invention relates to the extraction of precious metals from low grade feed, and in particular relates to the electrolytic production of precious metals.

BACKGROUND OF THE INVENTION

In spite of its vast gold and silver reserves, the United States still relies on imports for its precious metals. According to Government figures, more than 50% of the gold and 45% of the silver consumed domestically are imported from foreign countries. Obviously, this compounds the national economic difficulties with respect to the trade deficit. It is, therefore, important that an economic, efficient process be found for the recovery of gold and silver from low grade ores.

Many processes have been studied for the extraction of precious metals such as gold and silver from low grade ores. Cyanidation is a commonly employed process in which the gold and silver in crushed ore is dissolved in a dilute solution of sodium or calcium cyanide and a small amount of lime in the presence of oxygen, with the gold dissolving in the form of an aurocyanide complex. Recently, activated carbon and charcoal have been used to adsorb and recover the precious metals from the dilute solutions of alkaline cyanide or from other solutions, including sulfite and halide solutions, resulting from hydrometallurgical treatment of the ores. Such a process has also been used to adsorb and recover the precious metals in concentrates, wastes, tailings, and slimes. (See, for example, Heinen et al, "Processing Gold Ores Using Heap Leach-Carbon Adsorption Methods," U.S BuMines IC 8770 (1978); and "Carbon-in-Pulp Gold Recovery Process," J. S. Afr. Min. Eng. 90 (4152) (1979)).

The adsorbed precious metals must still be eluted or desorbed before the precious metals can be prepared from the eluate by other processes. These other processes include an electrowinning of the desorbed gold solution to obtain the metal values. Another process includes the chemical precipitation of the precious metals. A chemical stripping process disclosing the desorption of loaded activated carbon is disclosed in the Heinen U.S Pat. No. 4,208,378. This patent also discloses the use of electrolysis to win metal values from a stripping solution. Another process is the Zadra process (see BuMines RI 4843 (1952)) in which a sodium hydroxide, sodium cyanide mixture (NaOH-NaCN) at 95° C. is used to elute the gold adsorbed on carbon. However, this process takes 50 to 100 hours to elute 300 ounces of gold per ton adsorbed. The precious metals are then electrowon from the cyanide eluate.

Although recent improvements have been made in the composition of eluates and conditions to shorten desorbing time, the metals adsorption-desorption and metal preparation for producing the precious metals is a two-step process. The precious metals adsorbed on the carbon must first be desorbed and secondly must be produced from the eluates by other means. Other methods of obtaining the precious metals from the loaded carbon has included burning the carbon, but that process is very expensive.

Processes which attempt to overcome the problem of economically obtaining the precious metals from a leaching solution are disclosed in a number of U.S.

patents. The Hazen U.S. Pat. No. 3,767,543 discloses an electrolytic process for removing copper directly from a chloride leach solution. The aforementioned Heinen et al patent discloses in its discussion of the background of the invention a somewhat analogous process for removing gold. The Loretto U.S. Pat. No. 3,926,752 and the Fraser U.S. Pat. No. 4,204,922 disclose other methods of recovering metals from ore through the use of electrolysis of a solution. The Hazen and Loretto patents disclose processes relating to the metal copper, and the Fraser et al patent is more general in that it relates to the use of electrolysis of any metal in the cationic series such as copper, zinc, lead, nickel, tin, antimony, molybdenum, and silver. But again, these patents disclose processes which have multiple steps and thus are lengthy and expensive. Further, many of these processes disclose the use of complicated and expensive electrolysis with cells having diaphrams.

The prior art lacks an efficient and simple method for desorbing and producing precious metals from previously loaded activated carbon. In fact, none of the prior art processes discloses or discusses the feasibility of desorbing and simultaneously producing precious metals from loaded carbon or charcoal.

SUMMMARY OF THE INVENTION

The present invention relates to the preparation of precious metals by the electrolysis of loaded, activated carbon and eliminates the cumbersome adsorption-desorption-reduction process for producing precious metals. The present process is more efficient than those of the prior art at least with respect to reagent, energy, and time requirements.

It is an objective of the present invention to provide an electrolytic process by which precious metals are produced directly from loaded active carbon or charcoal in a one-step process. It is another object of the present invention by which gold or silver is desorbed and reduced directly and simultaneously to metal from gold and silver loaded carbon.

It is a further object to provide a process that is simple and economic for producing silver and gold metal from gold and silver loaded carbon.

The principle utility of the present invention is the electrolytic production of precious metals directly from an activated carbon anode which has been loaded with gold or silver. The invention is applicable to the recovery or production of precious metals from an electrically conductive medium in which the precious metals are dissolved, adsorbed, adhered or plated and from precious metal minerals, ores, concentrates, or mine wastes which are conductive or can be made electrically conductive. In particular, the present invention takes advantage of the electrical conductivity of carbon through which the adsorbed precious metals can be eluted and simultaneously deposited as virgin metals by electrolysis in a single step.

Although the process can be carried out with various kinds of carbon on which has been adsorbed silver and gold complexes, it is preferably carried out with activiated carbon. Activated carbon is a very efficient adsorbent of gold and silver complexes.

DETAILED DESCRIPTION OF THE PREFERRED EMBODIMENTS

The process according to the present invention is based on the electrolytically conductive property of preferably activated carbon from which the sorbed precious metals can be desorbed and converted to virgin metals simultaneously through electrolysis. Using the sorbed aurocyanide complex as an example, the electrochemical reactions within a process cell can be characterized by the following equations:

At the Anode:

$$C(Au(CN)_2)+2OH^- \rightarrow C^{2+}+2e^-+2Au(CN)_2^-+H_2O+\tfrac{1}{2}O_2\uparrow \quad (1)$$

At the Cathode:

$$2Au(CN)_2^-+2e^- \rightarrow 2Au^\circ+4CN^-$$

The net reaction:

$$C(Au(CN)_2)_2+2OH^- \rightarrow 2Au^\circ+C^{2+}+4CN^-+H_2O+\tfrac{1}{2}O_2\uparrow \quad (3)$$

$C(Au(CN)_2)_2$ is the gold cyanide complex ion adsorbed on the carbon, and $C^{2+}$ is the regenerated carbon after the desorption.

Similar equations can be expressed for desorbing silver cyanide complex and producing silver metal simultaneously by electrolysis of a silver-loaded carbon. The electrolysis regenerates the active sites of the carbon by desorbing the precious metal complexes which are reduced to precious metals on the cathode.

The present process was demonstrated in a one liter reaction kettle equipped with openings for the anode, cathode, a condenser, and a temperature sensor. Electrolyte mixing was provided by a magnetic stirring bar. Temperature of the electrolyte was maintained by a hot plate. To ensure that the conductance was distributed equally among the loaded carbon particles, the carbon particles were contained in a cylindrical graphite container having an outer diameter of 1½ inches, an inner diameter of 1⅛ inches, and a length of 6 inches. The wall of the cylinder was perforated with ⅛ inch holes spaced ½ inch apart horizontally and vertically. The anode current to the loaded carbon was conducted through the cylinder by a ⅜ inch outer diameter graphite rod positioned in the center of the cylinder, and fastened at the bottom of the cylinder. The internal volume of the cylinder which contained the loaded carbon was approximately 6 cubic inches (98 cubic centimeters). The cathode was either a ½ inch outer diameter graphite rod, a ⅜ inch outer diameter tungsten rod or a 1/16 inch thick copper plate.

The size of the loaded carbon particles was approximately minus 6 plus 16 to minus 12 plus 30 mesh, although other convenient sizes used in industrial adsorption processess can be used. The carbon particles were packed to provide an intimate contact individually and to the anode cylinder. This requirement, however, does not appear to be too critical because well-packed carbon columns used to adsorb precious metals can also be used as the anode assembly after the adsorption step.

The electrolyte was comprised of an equal volume mixture of 0.5N sodium hydroxide and 0.1N sodium cyanide, although electrolyte of other combinations can also be used if the alkalinity is maintained as required by equation (1). Electrolysis was conducted at temperatures of 40° and 86° C. However, temperature apparently had no effect on the deposition of the precious metals. Furthermore, it was found that the voltage and current are not critical so long as they are sufficient to maintain a good mass transfer from the anode to the electrolyte and a good formation of precious metal deposits on the cathode.

In the cell used in the examples set forth below, the cathode and anode distance was approximately ¾ inch apart. However, other distances can be employed to obtain the best mass transfer in the electrolytic reactions. Stirring was not found to be important because good mixing of the electrolyte was provided by the generation of anodic oxygen. The aforementioned condenser was necessary to prevent the loss of water through evaporation, especially when the electrolysis was conducted at a temperature of greater than 50° C.

Activated carbon, suitable for use in the present invention is a widely available material that is conventionally used in adsorption processes, including precious metal adsorption. It may be derived from any of a variety of sources such as coal, petroleum chars, coconut shell, or pulp mill black ash, and is activated by conventional means such as heating in a steam-air mixture at a temperature of about 850° C.

The activated carbon absorbent can be initially loaded by any conventional means. One such mean is by contacting a precious metal cyanide complex solution such as gold-cyanide or silver-cyanide complex. One such source of the solution can be the effluent from a cyanide plant. The activated carbon can be placed in contact with the effluent for a time sufficient to permit adsorption of a major amount of the precious metal cyanide complex. This may be accomplished by any conventional means for contacting liquids with solid adsorbents, for example by passing the solution through a columnar unit containing a fixed bed of the activated carbon as mentioned above. Alternatively, the above mentioned graphite container can be packed with carbon particles and then the container subjected to the eluate from a heap leach carbon adsorption cyanide process.

The following examples will more specifically illustrate the practice of the invention and the advantages obtained thereby.

EXAMPLE 1

The anode container contained 31.2 grams of activated carbon loaded with 230 ounces of gold per ton of carbon. Electrolysis was conducted with a current of 2 amperes at 2.8 volts for 6 hours in an electrolyte composed of an equal mixture of 0.5N NaOH and 0.1N NaCN at 86° C. The gold deposit after electrolysis was dissolved in 50 ml volume of aqua regia solution. Analysis showed that the electrolyte contained 9.4 mg of gold per liter and that the aqua regia solution contained 2.2 grams of gold per liter. The activated carbon after electolysis contained 120 ounces of gold per ton. The energy consumed by the electrolysis was 9.3 kilowatt-hours per ounce of gold. The test demonstrated the feasibility of obtaining gold by electrolysis of the loaded activated carbon in a single step.

EXAMPLE 2

The anode container contained 30.4 grams of activated carbon loaded with gold as set forth in Example 1. Electrolysis at 40° C. was conducted with a current of 0.07 ampere at an applied 2.0 volts for 308 hours. The gold was deposited at a tungsten cathode. Analysis showed that the electrolyte contained 0.3 mg of gold per liter, and the carbon contained 155 ounces of gold per ton after the electrolysis. The power consumption was 17.2 kilowatt-hours per ounce of gold. This test demonstrated that gold can be electrolytically prepared at low temperature and low current density.

EXAMPLE 3

Twenty-two grams of activated carbon loaded with 300 ounces of silver per ton of carbon was electrolyzed at 90° C. with a current of 2 amperes at an applied voltage of 3.2 volts for 6 hours. A 1/16 inch thick copper plate was used as the cathode. The silver deposit was dissolved in 0.54 liters of 20% nitric acid solution. The solution contained 0.4 grams of silver per liter. After electrolysis, the carbon contained 18.6 ounces of silver per ton, and the electrolyte contained 0.7 mg of silver per liter. The power consumption was 5.7 kilowatt-hours per ounce of silver. This test illustrates that the electrolytic process can prepare silver directly from silver loaded activated carbon.

It is apparent that improvement can be made on the aforedescribed cell design, electrode materials, and electrolyte compositions. For example, the cell design can be improved to accommodate carbon anode columns of industrial sizes. Commercially available Dimensionally Stable Anode can be used to contruct the anodic cylinder to improve the electrical conductivity and to facilitate the material handling characteristics. The anode device should be suitable for use as a carbon column in the precious metal adsorption step. Any convenient electrical conductor can be used. Less preferably the cathode can be constructed of activated carbon. Furthermore, the precious metal deposited on the particles of activated carbon can be recovered by burning off the carbon without consuming a large carbon investment. Advantageously, the cathode is made of tungsten, graphite, and copper on antimony. After the silver or gold is plated on the cathode, the gold or silver can be stripped from it and purified by the usual smelting procedures.

According to the process of the present invention, small cyanide consumption can be expected because of the oxidation by oxygen generated in the anode and the readsorption of the cyanide ion by the active site of the carbon during electrolysis. Other electrolyte systems can be used so long as they provide the necessary alkalinity to sustain the electrolytic reaction and are compatible with the solution systems used in the precious metal leaching process. For instance, solution systems of potassium hydoxide and the potassium cyanide salt can be used.

The present invention has been described with respect to preferred embodiments thereof. A principal feature of the present invention is the electrolytic preparation of precious metals from loaded activated carbon in a single-step process. Modifications to the present invention would be obvious to those of ordinary skill in the art. For example, although the invention has been described using activated carbon sorbed with gold and silver cyanide complex, similar results can be obtained from activated carbon or other conductive media sorbed with other precious metal anion complexes such as sulfite and halides. Accordingly, the present electrolytic process can be used with gold and silver complexes of sulfites and chlorides as well as with other known precious metal anion complexes. Further, it can also be appreciated that mixtures of such precious metal complexes can be converted to the mixtures of the precious metal on the cathode in the same way.

We claim:

1. A simple one-step economic process for the desorption of a precious metal complex from carbon that has been loaded with the precious metal complex and conversion of the precious metal complex to the precious metal, comprising, (a) forming an anode with the loaded carbon on which is absorbed the precious metal complex in an electrolytic cell containing an electolyte and a cathode, and (b) passing an electric current through said cell thereby resulting in the deposition of the precious metal on said cathode.

2. The process as claimed in claim 1 wherein said precious metal complex is selected from the class consisting of an aurocyanide complex, a silver cyanide complex, and mixtures thereof.

3. The process as claimed in claim 2 wherein said cathode is selected from the class consisting of carbon, tungsten, and copper.

4. The process as claimed in claim 1 wherein said carbon anode comprises activated carbon loaded with the precious metal complex.

5. The process as claimed in claim 4 wherein said carbon anode comprises a cylindrical carbon container having a bore therein and wherein said bore is packed with said loaded activated carbon.

6. The process as claimed in claim 5 wherein said cylindrical container has walls of graphite and has perforations through said cylindrical walls.

7. The process as claimed in claim 1 wherein said electrolyte is alkaline.

8. The process as claimed in claim 7 wherein said electrolyte consists of an equal volume mixture of about 0.5 normal sodium hydroxide solution and about 0.1 normal sodium cyanide solution.

9. The process as claimed in claim 1 wherein said cathode is carbon; and further comprising, recovering said deposited precious metal by burning off the carbon of said cathode.

10. The process as claimed in claim 1 wherein the loaded carbon is loaded with a precious metal cyanide complex and is the anode; and wherein the electrolytic reaction at the anode is as follows:

$$C(M(CN)_2)+2OH^- \rightarrow C^{2+}+2e^-+2M(CN)_2^-+H_2O+\tfrac{1}{2}O_2\uparrow$$

where "M" is a precious metal, C $(M(CN)_2)$ is a precious metal cyanide complex sorbed on activated carbon, and $M(CN)_2^-$ is a precious metal cyanide complex-ion.

11. The one-step process for recovering precious metals comprising loading carbon with a precious metal complex;

placing said loaded carbon as an anode in an electrolytic cell that contains an electrolyte and having a cathode; and subjecting the cell to an electric current to electroplate said cathode with said precious metal.

12. The process as claimed in claim 11 wherein said carbon is loaded with a precious metal from a heap leach carbon adsorption cyanide process.

13. The process as claimed in claim 12 wherein said anode is comprised of a cylindrical container having a bore therein; wherein said bore is packed with loaded carbon particles.

14. The process as claimed in claim 13 wherein said loading step comprises subjecting a carbon container packed with unloaded carbon particles to a precious metal adsorption process to load said particles with the precious metal complex; and placing said subjected container as said anode in said electrolytic cell.

15. The process as claimed in claim 14 wherein said carbon particles are activated carbon.

* * * * *